US005276765A

United States Patent [19]

Freeman et al.

[11] Patent Number: 5,276,765

[45] Date of Patent: Jan. 4, 1994

[54] VOICE ACTIVITY DETECTION

[75] Inventors: Daniel K. Freeman; Ivan Boyd, both of Ipswich, England

[73] Assignee: British Telecommunications public limited Company, London, England

[21] Appl. No.: 952,147

[22] PCT Filed: Mar. 10, 1989

[86] PCT No.: PCT/GB89/00247

§ 371 Date: Aug. 15, 1990

§ 102(e) Date: Aug. 15, 1990

[87] PCT Pub. No.: WO89/08910

PCT Pub. Date: Sep. 21, 1989

Related U.S. Application Data

[63] Continuation of Ser. No. 555,445, Aug. 15, 1990, abandoned.

[30] Foreign Application Priority Data

Mar. 11, 1988 [GB] United Kingdom ..... 8805795
Aug. 6, 1988 [GB] United Kingdom ..... 8813346
Aug. 24, 1988 [GB] United Kingdom ..... 8820105

[51] Int. Cl.[5] ..... G10L 5/00

[52] U.S. Cl. ..... 395/2

[58] Field of Search ..... 395/2; 381/71, 94, 46-50

[56] References Cited

U.S. PATENT DOCUMENTS 4,227,046 10/1980 Nakajima et al. ..... 381/47
4,283,601 8/1981 Nakajima et al. ..... 381/47
4,338,738 11/1982 Kahn ..... 381/94
4,672,669 6/1987 DesBlache et al. ..... 381/46
4,696,039 9/1987 Doddington ..... 381/46
4,731,846 3/1988 Secrest et al. ..... 381/49

OTHER PUBLICATIONS

Rabiner et al., "Application of an LPC Distance Measure to the Voiced-Unvoiced-Silence Detection Problem", IEEE Trans. on ASSP, vol. ASSP-25, No. 4, Aug. 1977, pp. 338-343.

McAulay, "Optimum Speech Classification and Its Application to Adaptive Noise Cancellation", 1977 IEEE ICASSP, Hartford, CN, May 9-11, 1977, pp. 425-428.

Un, "Improving LPC Analysis of Noisy Speech by Autocorrelation Subtraction Method", ICASSP '81, Atlanta, GA, Mar. 30, 31, Apr. 1981, pp. 1082-1085.

*Primary Examiner*—David D. Knepper
*Attorney, Agent, or Firm*—Nixon & Vanderhye

[57] ABSTRACT

Voice activity detector (VAD) for use in an LPC coder in a mobile radio system uses autocorrelation coefficient $R_0$, $R_1$ . . . of the input signal, weighted and combined, to provide a measure M which depends on the power within that part of the spectrum containing no noise, which is thresholded against a variable threshold to provide a speech/no speech logic output. The measure is formula (I), where $H_i$ are the autocorrelation coefficients of the impulse response of an Nth order FIR inverse noise filter derived from LPC analysis of previous non-speech signal frames. Threshold adaption and coefficient update are controlled by a second VAD response to rate of spectral change between frames.

23 Claims, 3 Drawing Sheets

VOICE ACTIVITY DETECTION

This is a continuation of application Ser. No. 07/555,445, filed Aug. 15, 1990, now abandoned.

BACKGROUND OF THE INVENTION

A voice activity detector is a device which is supplied with a signal with the object of detecting periods of speech, or periods containing only noise. Although the present invention is not limited thereto, one application of particular interest for such detectors is in mobile radio telephone systems where the knowledge as to the presence or otherwise of speech can be used and exploited by a speech coder to improve the efficient utilisation of radio spectrum, and where also the noise level (from a vehicle-mounted unit) is likely to be high.

The essence of voice activity detection is to locate a measure which differs appreciably between speech and non-speech periods. In apparatus which includes a speech coder, a number of parameters are readily available from one or other stage of the coder, and it is therefore desirable to economise on processing needed by utilising some such parameter. In many environments, the main noise sources occur in known defined areas of the frequency spectrum. For example, in a moving car much of the noise (e.g., engine noise) is concentrated in the low frequency regions of the spectrum. Where such knowledge of the spectral position of noise is available, it is desirable to base the decision as to whether speech is present or absent upon measurements taken from that portion of the spectrum which contains relatively little noise. It would, of course, be possible in practice to pre-filter the signal before analysing to detect speech activity, but where the voice activity detector follows the output of a speech coder, prefiltering would distort the voice signal to be coded.

SUMMARY OF THE INVENTION

According to the invention there is provided a voice activity detection apparatus comprising means for receiving an input signal, means for periodically adaptively generating an estimate of the noise signal component of the input signal, means for periodically forming a measure M of the spectral similarity between a portion of the input signal and the noise signal component, means for comparing a parameter derived from the measure M with a threshold value T, and means for producing an output to indicate the presence or absence of speech in dependence upon whether or not that value is exceeded.

Preferably, the measure is the Itakura-Saito Distortion Measure.

BRIEF DESCRIPTION OF THE DRAWINGS

Other aspects of the present invention are as defined in the claims.

Some embodiments of the invention will now be described, by way of example, with reference to the accompanying drawings, in which.

DETAILED DESCRIPTION OF THE DRAWINGS

Figure 1:
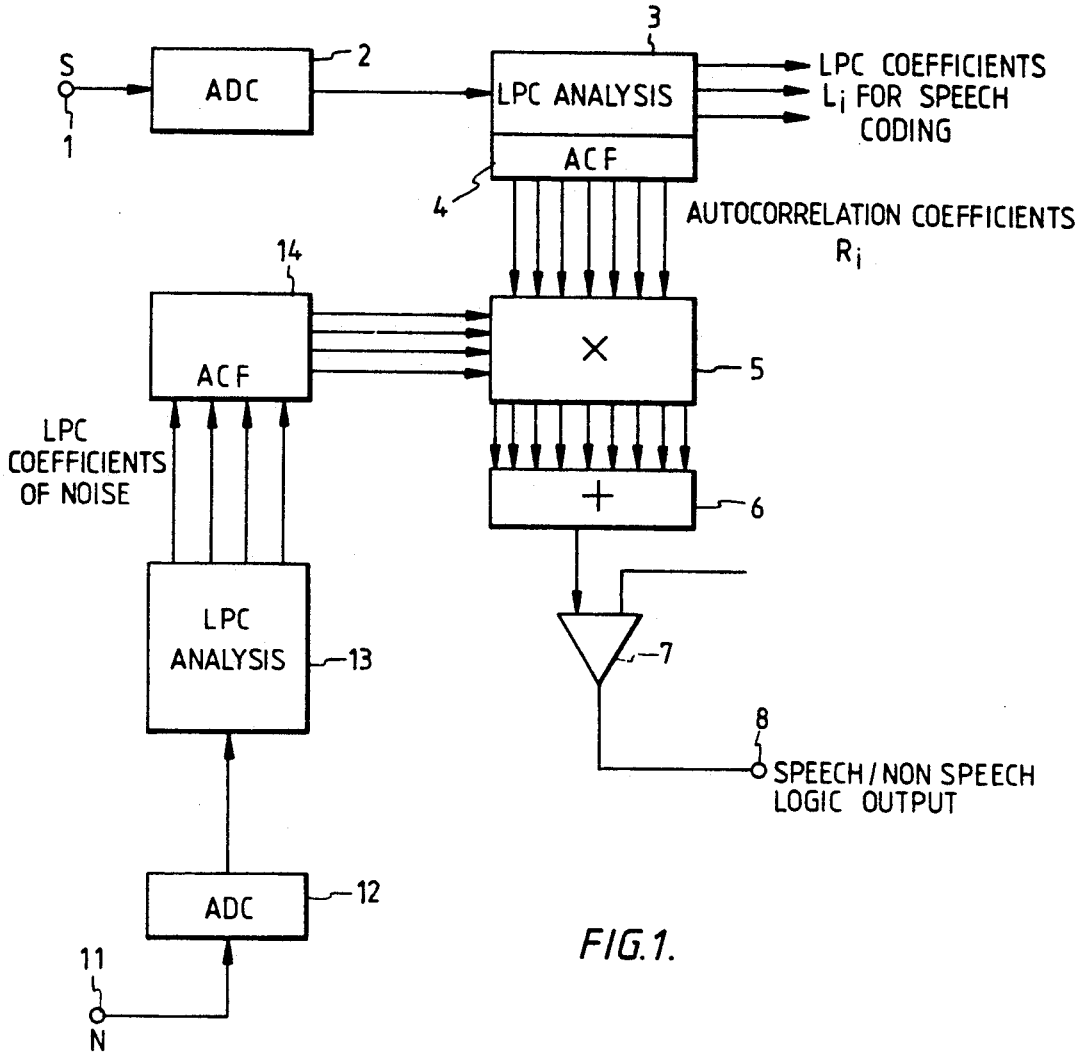
FIG. 1 is a block diagram of a first embodiment of the invention.

The general principle underlying a first Voice Activity Detector according to the a first embodiment of the invention is as follows.

A frame of n signal samples $$
\begin{aligned}
s' = (&s_0),\\
&(s_1 + h_0 s_0),\\
&(s_2 + h_0 s_1 + h_1 s_0),\\
&(s_3 + h_0 s_2 + h_1 s_1 + h_2 s_0),\\
&(s_4 + h_0 s_3 + h_1 s_2 + h_2 s_1 + h_1 s_0),\\
&(s_5 + h_0 s_4 + h_1 s_3 + h_2 s_2 + h_3 s_1),\\
&(s_6 + h_0 s_5 + h_1 s_4 + h_2 s_3 + h_3 s_2),\\
&(s_7 \ldots)
\end{aligned}
$$

The zero order autocorrelation coefficient is the sum of each term squared, which may be normalized i.e. divided by the total number of terms (for constant frame lengths it is easier to omit the division); that of the filtered signal is thus $$R'_0 = \sum_{i=0}^{n-1} (s'_i)^2$$

and this is therefore a measure of the power of the notional filtered signal s'—in other words, of that part of the signal s which falls within the passband of the notional filter.

Expanding, neglecting the first 4 terms, $$
\begin{aligned}
R'_0 &= (s_4 + h_0 s_3 + h_1 s_1 + h_2 s_1 + h_3 s_0)^2\\
&\quad + (s_5 + h_0 s_4 + h_1 s_3 + h_2 s_2 + h_3 s_1)^2\\
&\quad + \ldots\\
&= s_4^2 + h_0 s_4 s_3 + h_1 s_4 s_2 + h_2 s_4 s_1 + h_3 s_4 s_0\\
&+ h_0 s_4 s_3 + h_0^2 s_0^2 + h_0 h_1 s_3 s_2 + h_0 h_2 s_3 s_1 + h_0 h_3 s_3 s_0\\
&+ h_1 s_4 s_2 + h_0 h_1 s_3 s_2 + h_1^2 s_2^2 + h_1 h_2 s_2 s_1 + h_1 h_3 s_2 s_0\\
&+ h_2 s_4 s_1 + h_0 h_1 s_3 s_1 + h_1 h_2 s_2 s_1 + h_2^2 s_2^2 + h_2 h_3 s_1 s_0\\
&+ h_3 s_4 s_0 + h_0 h_3 s_3 s_0 + h_1 h_3 s_2 s_0 + h_2 h_3 s_1 s_0 + h_3^2 s_2^0\\
&+ \ldots\\
&= R_0(1 + h_0^2 + h_1^2 + h_2^2 + h_3^2)\\
&+ R_1(2h_0 + 2h_0 h_1 + 2h_1 h_2 + 2h_2 h_3)\\
&+ R_2(2h_1 + 2h_1 h_3 + 2h_0 h_2)\\
&+ R_3(2h_2 + 2h_0 h_3)\\
&+ R_4(2h_3)
\end{aligned}
$$

So $R'_0$ can be obtained from a combination of the autocorrelation coefficients $R_i$, weighted by the bracketed constants which determine the frequency band to which the value of $R'_0$ is responsive. In fact, the bracketed terms are the autocorrelation coefficients of the impulse response of the notional filter, so that the expression above may be simplified to $$R'_0 = R_0 H_0 + 2 \sum_{i=1}^{N} R_i H_i, \qquad (1)$$

where N is the filter order and $H_i$ are the (un-normalised) autocorrelation coefficients of the impulse response of the filter.

In other words, the effect on the signal autocorrelation coefficients of filtering a signal may be simulated by producing a weighted sum of the autocorrelation coefficients of the (unfiltered) signal, using the impulse response that the required filter would have had.

Thus, a relatively simple algorithm, involving a small number of multiplication operations, may simulate the effect of a digital filter requiring typically a hundred times this number of multiplication operations.

This filtering operation may alternatively be viewed as a form of spectrum comparison, with the signal spectrum being matched against a reference spectrum (the inverse of the response of the notional filter). Since the notional filter in this application is selected so as to approximate the inverse of the noise spectrum, this operation may be viewed as a spectral comparison between speech and noise spectra, and the zeroth autocorrelation coefficient thus generated (i.e. the energy of the inverse filtered signal) as a measure of dissimilarity between the spectra. The Itakura-Saito distortion measure is used in LPC to assess the match between the predictor filter and the input spectrum, and in one form is expressed as $$M = R_0A_0 + 2\sum_{i=1}^{N} R_iA_i,$$

where $A_0$ etc are the autocorrelation coefficients of the LPC parameter set. It will be seen that this is closely similar to the relationship derived above, and when it is remembered that the LPC coefficients are the taps of an FIR filter having the inverse spectral response of the input signal so that the LPC coefficient set is the impulse response of the inverse LPC filter, it will be apparent that the Itakura-Saito Distortion Measure is an fact merely a form of equation 1, wherein the filter response H is the inverse of the spectral shape of an all-pole model of the input signal.

In fact, it is also possible to transpose the spectra, using the LPC coefficients of the test spectrum and the autocorrelation coefficients of the reference spectrum, to obtain a different measure of spectral similarity.

The I-S Distortion measure is further discussed in "Speech Coding based upon Vector Quantisation" by A Buzo, A H Gray, R M Gray and J D Markel, IEEE Trans on ASSP, Vol ASSP-28, No 5, October 1980.

Since the frames of signal have only a finite length, and a number of terms (N, where N is the filter order) are neglected, the above result is an approximation only; it gives, however, a surprisingly good indicator of the presence or absence of speech and thus may be used as a measure M in speech detection. In an environment where the noise spectrum is well known and stationary, it is quite possible to simply employ fixed $h_0$, $h_1$ etc coefficients to model the inverse noise filter.

However, apparatus which can adapt to different noise environments is much more widely useful.

Referring to FIG. 1, in a first embodiment, a signal from a microphone (not shown) is received at an input 1 and converted to digital samples s at a suitable sampling rate by an analogue to digital converter 2. An LPC analysis unit 3 (in a known type of LPC coder) then derives, for successive frames of n (e.g. 160) samples, a set of N (e.g. 8 or 12) LPC filter coefficients $L_i$ which are transmitted to represent the input speech. The speech signal s also enters a correlator unit 4 (normally part of the LPC coder 3 since the autocorrelation vector $R_i$ of the speech is also usually produced as a step in the LPC analysis although it will be appreciated that a separate correlator could be provided). The correlator 4 produces the autocorrelation vector $R_i$, including the zero order correlation coefficient $R_0$ and at least 2 further autocorrelation coefficients $R_1$, $R_2$, $R_3$. These are then supplied to a multiplier unit 5.

A second input 11 is connected to a second microphone located distant from the speaker so as to receive only background noise. The input from this microphone is converted to a digital input sample train by AD converter 12 and LPC analysed by a second LPC analyser 13. The "noise" LPC coefficients produced from analyser 13 are passed to correlator unit 14, and the autocorrelation vector thus produced is multiplied term by term with the autocorrelation coefficients $R_i$ of the input signal from the speech microphone in multiplier 5 and the weighted coefficients thus produced are combined in adder 6 according to Equation 1, so as to apply a filter having the inverse shape of the noise spectrum from the noise-only microphone (which in practice is the same as the shape of the noise spectrum in the signal-plus-noise microphone) and thus filter out most of the noise. The resulting measure M is thresholded by thresholder 7 to produce a logic output 8 indicating the presence or absence of speech; if M is high, speech is deemed to be present.

This embodiment does, however, require two microphones and two LPC analysers, which adds to the expense and complexity of the equipment necessary.

Alternatively, another embodiment uses a corresponding measure formed using the autocorrelations from the noise microphone 11 and the LPC coefficients from the main microphone 1, so that an extra autocorrelator rather than an LPC analyser is necessary.

These embodiments are therefore able to operate within different environments having noise at different frequencies, or within a changing noise spectrum in a given environment.

Figure 2:
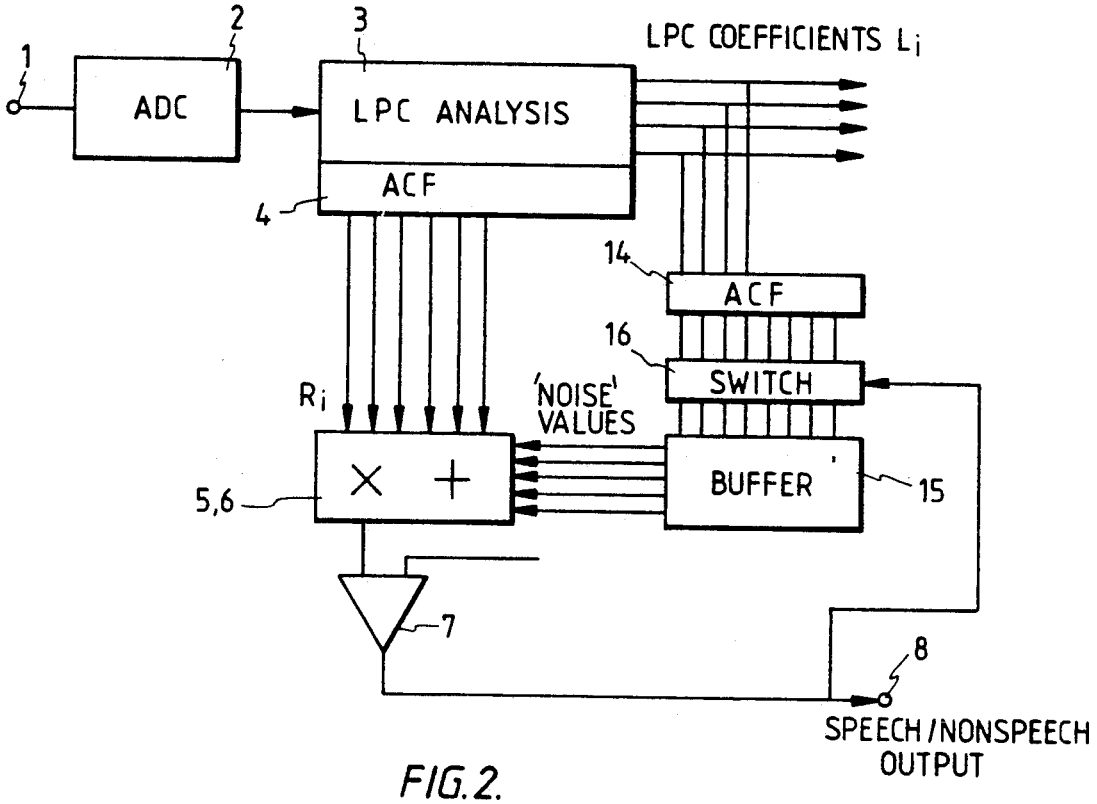
FIG. 2 shows a second embodiment of the invention.

Referring to FIG. 2, in the preferred embodiment of the invention, there is provided a buffer 15 which stores a set of LPC coefficients (or the autocorrelation vector of the set) derived from the microphone input 1 in a period identified as being a "non speech" (i.e. noise only) period. These coefficients are then used to derive a measure using equation 1, which also of course corresponds to the Itakura-Saito Distortion Measure, except that a single stored frame of LPC coefficients corresponding to an approximation of the inverse noise spectrum is used, rather than the present frame of LPC coefficients.

The LPC coefficient vector $L_i$ output by analyser 3 is also routed to a correlator 14, which produces the autocorrelation vector of the LPC coefficient vector. The buffer memory 15 is controlled by the speech/non-speech output of thresholder 7, in such a way that during "speech" frames the buffer retains the "noise" autocorrelation coefficients, but during "noise" frames a new set of LPC coefficients may be used to update the buffer, for example by a multiple switch 16, via which outputs of the correlator 14, carrying each autocorrelation coefficient, are connected to the buffer 15. It will be appreciated that correlator 14 could be positioned after buffer 15. Further, the speech/no-speech decision for coefficient update need not be from output 8, but could be (and preferably is) otherwise derived.

Since frequent periods without speech occur, the LPC coefficients stored in the buffer are updated from time to time, so that the apparatus is thus capable of tracking changes in the noise spectrum. It will be appreciated that such updating of the buffer may be necessary only occasionally, or may occur only once at the start of operation of the detector, if (as is often the case) the noise spectrum is relatively stationary over time, but in a mobile radio environment frequent updating is preferred.

In a modification of this embodiment, the system initially employs equation 1 with coefficient terms corresponding to a simple fixed high pass filter, and then subsequently starts to adapt by switching over to using "noise period" LPC coefficients. If, for some reason, speech detection fails, the system may return to using the simple high pass filter.

It is possible to normalise the above measure by dividing through by $R_0$, so that the expression to be thresholded has the form $$M = A_0 + 2 \sum_{i=1}^{N} \frac{R_i A_i}{R_0}$$

This measure is independent of the total signal energy in a frame and is thus compensated for gross signal level changes, but gives rather less marked contrast between "noise" and "speech" levels and is hence preferably not employed in high-noise environments.

Instead of employing LPC analysis to derive the inverse filter coefficients of the noise signal (from either the noise microphone or noise only periods, as in the various embodiments described above), it is possible to model the inverse noise spectrum using an adaptive filter of known type; as the noise spectrum changes only slowly (as discussed below) a relatively slow coefficient adaption rate common for such filters is acceptable. In one embodiment, which corresponds to FIG. 1, LPC analysis unit 13 is simply replaced by an adaptive filter (for example a transversal FIR or lattice filter), connected so as to whiten the noise input by modelling the inverse filter, and its coefficients are supplied as before to autocorrelator 14.

In a second embodiment, corresponding to that of FIG. 2, LPC analysis means 3 is replaced by such an adaptive filter, and buffer means 15 is omitted, but switch 16 operates to prevent the adaptive filter from adapting its coefficients during speech periods.

A second Voice Activity Detector for use with another embodiment of the invention will now be described.

From the foregoing, it will be apparent that the LPC coefficient vector is simply the impulse response of an FIR filter which has a response approximating the inverse spectral shape of the input signal. When the Itakura-Saito Distortion Measure between adjacent frames is formed, this is in fact equal to the power of the signal, as filtered by the LPC filter of the previous frame. So if spectra of adjacent frames differ little, a correspondingly small amount of the spectral power of a frame will escape filtering and the measure will be low. Correspondingly, a large interframe spectral difference produces a high Itakura-Saito Distortion Measure, so that the measure reflects the spectral similarity of adjacent frames. In a speech coder, it is desirable to minimise the data rate, so frame length is made as long as possible; in other words, if the frame length is long enough, then a speech signal should show a significant spectral change from frame to frame (if it does not, the coding is redundant). Noise, on the other hand, has a slowly varying spectral shape from frame to frame, and so in a period where speech is absent from the signal then the Itakura-Saito Distortion Measure will correspondingly be low—since applying the inverse LPC filter from the previous frame "filters out" most of the noise power.

Typically, the Itakura-Saito Distortion Measure between adjacent frames of a noisy signal containing intermittent speech is higher during periods of speech than periods of noise; the degree of variation (as illustrated by the standard deviation) is also higher, and less intermittently variable.

It is noted that the standard deviation of the standard deviation of M is also a reliable measure; the effect of taking each standard deviation is essentially to smooth the measure.

In this second form of Voice Activity Detector, the measured parameter used to decide whether speech is present is preferably the standard deviation of the Itakura-Saito Distortion Measure, but other measures of variance and other spectral distortion measures (based for example on FFT analysis) could be employed.

It is found advantageous to employ an adaptive threshold in voice activity detection. Such thresholds must not be adjusted during speech periods or the speech signal will be thresholded out. It is accordingly necessary to control the threshold adapter using a speech/non-speech control signal, and it is preferable that this control signal should be independent of the output of the threshold adapter. The threshold T is adaptively adjusted so as to keep the threshold level just above the level of the measure M when noise only is present. Since the measure will in general vary randomly when noise is present, the threshold is varied by determining an average level over a number of blocks, and setting the threshold at a level proportional to this average. In a noisy environment this is not usually sufficient, however, and so an assessment of the degree of variation of the parameter over several blocks is also taken into account.

The threshold value T is therefore preferably calculated according to $$T = M' + K \cdot d$$

where M' is the average value of the measure over a number of consecutive frames, d is the standard deviation of the measure over those frames, and K is a constant (which may typically be 2).

In practice, it is preferred not to resume adaptation immediately after speech is indicated to be absent, but to wait to ensure the fall is stable (to avoid rapid repeated switching between the adapting and non-adapting states).

Figure 3:
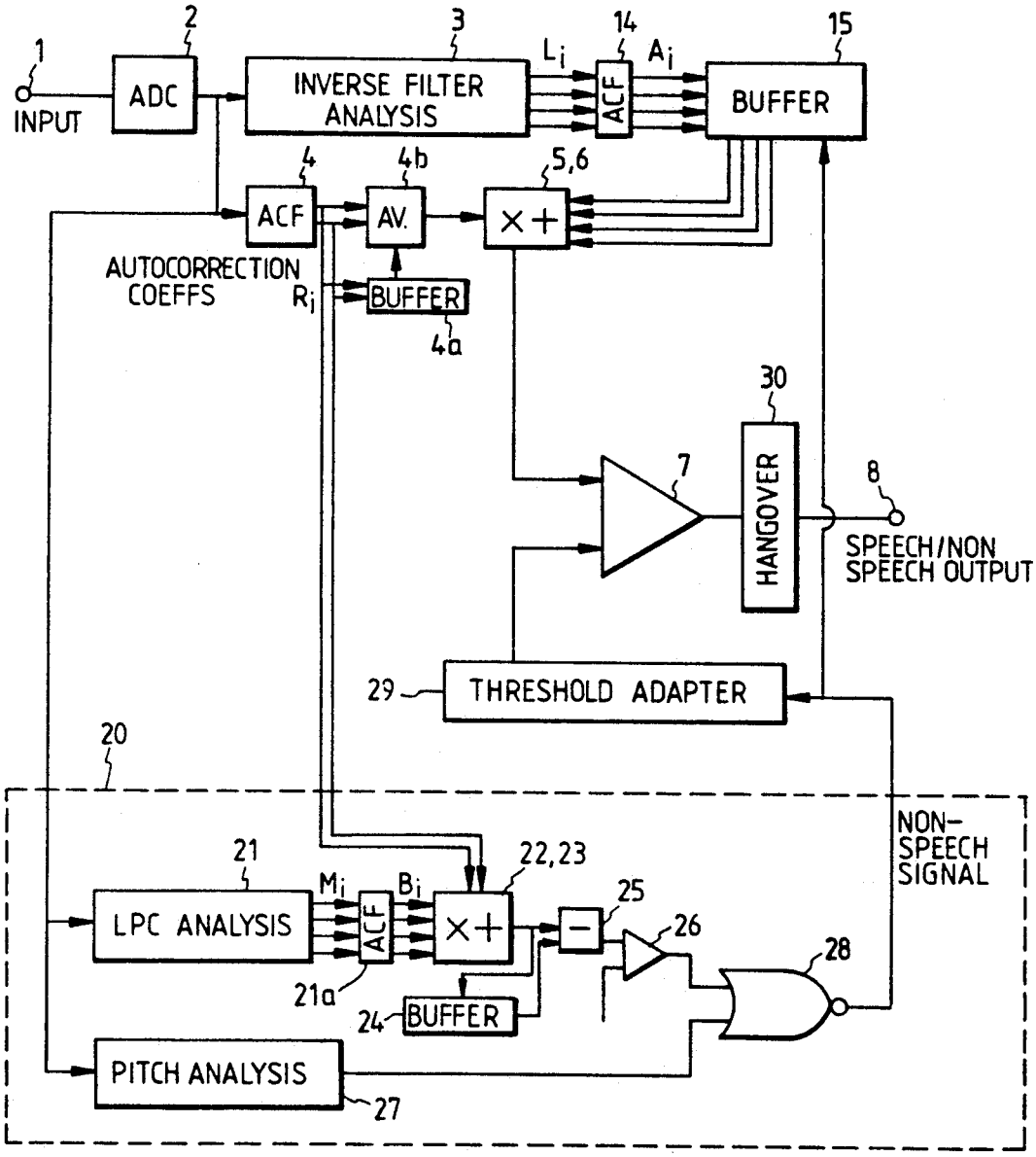
FIG. 3 shows a third, preferred embodiment of the invention.

Referring to FIG. 3, in a preferred embodiment of the invention incorporating the above aspects, an input 1 receives a signal which is sampled and digitised by analogue to digital converter (ADC) 2, and supplied to the input of an inverse filter analyser 3, which in practice is part of a speech coder with which the voice activity detector is to work, and which generates coefficients $L_i$ (typically 8) of a filter corresponding to the inverse of the input signal spectrum. The digitised signal is also supplied to an autocorrelator 4, (which is part of analyser 3) which generates the autocorrelation vector $R_i$ of the input signal (or at least as many low order terms as there are LPC coefficients). Operation of these parts of the apparatus is as described in FIGS. 1 and 2. Preferably, the autocorrelation coefficients $R_i$ are then averaged over several successive speech frames (typically 5–20 ms long) to improve their reliability. This may be achieved by storing each set of autocorrelations coefficients output by autocorrelator 4 in a buffer **4*a*, and employing an averager 4*b*** to produce a weighted sum of the current autocorrelation coefficients $R_i$ and those from previous frames stored in and supplied from buffer 4a. The averaged autocorrelation coefficients $Ra_i$ thus derived are supplied to weighting and adding means 5,6 which receives also the autocorrelation vector $A_i$ of stored noise-period inverse filter coefficients $L_i$ from an autocorrelator 14 via buffer 15, and forms from $Ra_i$ and $A_i$ a measure M preferably defined as:

$$M = A_0 + 2\Sigma \frac{Ra_i A_i}{R_0},$$

This measure is then thresholded by thesholder 7 against a threshold level, and the logical result provides an indication of the presence or absence of speech at output 8.

In order that the inverse filter coefficients $L_i$ correspond to a fair estimate of the inverse of the noise spectrum, it is desirable to update these coefficients during periods of noise (and, of course, not to update during periods of speech). It is, however, preferable that the speech/non-speech decision on which the updating is based does not depend upon the result of the updating, or else a single wrongly identified frame of signal may result in the voice activity detector subsequently going "out of lock" and wrongly identifying following frames. Preferably, therefore, there is provided a control signal generating circuit 20, effectively a separate voice activity detector, which forms an independent control signal indicating the presence or absence of speech to control inverse filter analyser 3 (or buffer 15) so that the inverse filter autocorrelation coefficients $A_i$ used to form the measure M are only updated during "noise" periods. The control signal generator circuit 20 includes LPC analyser 21 (which again may be part of a speech coder and, specifically, may be performed by analyser 3), which produces a set of LPC coefficients $M_i$ corresponding to the input signal and an autocorrelator 21a (which may be performed by autocorrelator 3a) which derives the autocorrelation coefficients $B_i$ of $M_i$. If analyser 21 is performed by analyser 3, then $M_i = L_i$ and $B_i = A_i$. These autocorrelation coefficients are then supplied to weighting and adding means 22, 23 (equivalent to 5, 6) which receive also the autocorrelation vector $R_i$ of the input signal from autocorrelator 4. A measure of the spectral similarity between the input speech frame and the preceding speech frame is thus calculated; this may be the Itakura-Saito distortion measure between $R_i$ of the present frame and $B_i$ of the preceding frame, as disclosed above, or it may instead be derived by calculating the Itakura-Saito distortion measure for $R_i$ and $B_i$ of the present frame, and subtracting (in subtractor 25) the corresponding measure for the previous frame stored in buffer 24, to generate a spectral difference signal (in either case, the measure is preferably energy-normalised by dividing by $R_o$). The buffer 24 is then, of course, updated. This spectral difference signal, when thresholded by a thresholder 26 is, as discussed above, an indicator of the presence or absence of speech. We have found, however, that although this measure is excellent for distinguishing noise from unvoiced speech (a task which prior art systems are generally incapable of) it is in general rather less able to distinguish noise from voiced speech. Accordingly, there is preferably further provided within circuit 20 a voiced speech detection circuit comprising a pitch analyser 27 (which in practice may operate as part of a speech coder, and in particular may measure the long term predictor lag value produced in a multipulse LPC coder). The pitch analyser 27 produces a logic signal which is "true" when voiced speech is detected, and this signal, together with the threshold measure derived from thresholder 26 (which will generally be "true" when unvoiced speech is present) are supplied to the inputs of a NOR gate 28 to generate a signal which is "false" when speech is present and "true" when noise is present. This signal is supplied to buffer 15 (or to inverse filter analyser 3) so that inverse filter coefficients $L_i$ are only updated during noise periods.

Threshold adapter 29 is also connected to receive the non-speech signal control output of control signal generator circuit 20. The output of the threshold adapter 29 is supplied to thresholder 7. The threshold adapter operates to increment or decrement the threshold in steps which are a proportion of the instant threshold value, until the threshold approximates the noise power level (which may conveniently be derived from, for example, weighting and adding circuits 22, 23). When the input signal is very low, it may be desirable that the threshold is automatically set to a fixed, low, level since at the low signal levels the effect of signal quantisation produced by ADC 2 can produce unreliable results.

There may be further provided "hangover" generating means 30, which operates to measure the duration of indications of speech after thresholder 7 and, when the presence of speech has been indicated for a period in excess of a predetermined time constant, the output is held high for a short "hangover" period. In this way, clipping of the middle of low-level speech bursts is avoided, and appropriate selection of the time constant prevents triggering of the hangover generator 30 by short spikes of noise which are falsely indicated as speech. It will of course be appreciated that all the above functions may be executed by a single suitably programmed digital processing means such as a Digital Signal Processing (DSP) chip, as part of an LPC codec thus implemented (this is the preferred implementation), or as a suitably programmed microcomputer or microcontroller chip with an associated memory device.

Conveniently, as described above, the voice detection apparatus may be implemented as part of an LPC codec. Alternatively, where autocorrelation coefficients of the signal or related measures (partial correlation, or "parcor", coefficients) are transmitted to a distant station the voice detection may take place distantly from the codec.

I claim:

1. Voice activity detection apparatus comprising:

(i) means for receiving an electrical input signal in which the presence or absence of signals representing speech is to be detected;

(ii) means responsive to said means for receiving for periodically adaptively generating an electrical signal representing an estimated noise signal component of the input signal by producing the autocorrelation coefficients $A_i$ of the impulse response of a FIR filter having a response approximating the inverse of the short term spectrum of the noise signal component;

(iii) means responsive to said means for receiving for periodically forming from the input signal and the estimated noise representing signal an electrical signal representing a measure M of the spectral similarity between a portion of the input signal and the said estimated noise signal component, said measure forming means comprises means for producing electrical signals representing the autocorrelation coefficients $R_i$ of the input signal, and means connected to receive $R_i$ and $A_i$ signals, and to calculate the measure M therefrom; and (iv) electrical means responsive to said means for forming for comparing the electrical signals representing said measure with a threshold value representing signal to produce an electrical output indicating the presence or absence of speech in the electrical input signal.

2. Apparatus according to claim 1, further comprising an input arranged to receive a second electrical input signal, similarly subject to noise, from which speech is absent, in which the generating means comprise LPC analysis means for deriving values of $A_i$ from the second input signal.

3. Apparatus according to claim 1 in which the generating means includes an adaptive filter for generating said coefficients.

4. Apparatus according to claim 2 in which the means for producing the signals representing the autocorrelation coefficients of the input signal are arranged to do so in dependence upon the autocorrelation coefficients of several successive portions of the signal.

5. Apparatus according to claim 1 or 4, in which $$M=R_0A_0+2\Sigma R_iA_i.$$

6. Apparatus according to claim 1 or 4, in which $$M = A_0 + 2\Sigma \frac{R_iA_i}{R_0}.$$

7. Apparatus according to claims 1 or 4, in which said generating means comprises a buffer connected to store data from which the autocorrelation coefficients $A_i$ of the said filter response may be obtained, in which the said filter response is periodically calculated from the signal by LPC analysis means, the apparatus being so connected and controlled that the measure M is calculated using the said stored data, and the said stored data is updated only from periods in which speech is indicated to be absent.

8. Apparatus according to claim 7 further comprising second voice activity detection means responsive to said input signal for indicating the absence of speech to control the updating of the stored data.

9. Apparatus according to claims 1 or 4, further comprising means for adjusting said threshold value during periods when speech is indicated to be absent.

10. Apparatus according to claim 9 further comprising second voice activity detection means responsive to said input signal to produce a control signal indicating the presence or absence of speech, said adjusting means being responsive to said control signal to prevent adjustment of said threshold value when speech is present.

11. Apparatus according to claim 9 in which said threshold value is, when adjusted, adjusted to be equal to the mean of the measure plus a term which is a fraction of the standard deviation of the measure.

12. Apparatus according to claim 10 further comprising means for adjusting the said threshold value during periods when speech is indicated to be absent, said second voice activity detection means serving also to prevent adjustment of the threshold value when speech is present.

13. Apparatus according to claim 10 in which said second voice activity detection means comprises means for generating a measure of the spectral similarity between a portion of the input signal and earlier portions of the input signal.

14. Apparatus according to claim 13 in which the similarity measure generating means of said second voice activity detection means comprises means for providing, from LPC filter data and autocorrelation data relating to a present portion of the input signal, a present distortion measure; means for providing an equivalent past frame distortion measure corresponding to a preceding portion of the input signal, and means for generating a signal indicating the degree of similarity therebetween as an indicator of speech presence or absence.

15. Apparatus according to claim 13, in which said second voice activity detection means further comprises voiced speech detection means comprising pitch analysis means, for generating a signal indicative of the presence of voiced speech, upon which the output of said second voice activity detection means also depends.

16. Voice activity apparatus comprising:

(i) means for receiving an electrical signal in which the presence or absence or signals representing speech is to be detected;

(ii) means responsive to said means for receiving for periodically adaptively generating an electrical signal representing an estimated noise signal component of the input signal, said generating means including analysis means operable to produce electrical signals representative of the coefficients of a filter having a spectral response which is the inverse of the frequency spectrum of the estimated noise signal component;

(iii) means responsive to said means for periodically adaptively generating for periodically forming from the input signal and the estimated noise representing signal and electrical signal representing a measure of a spectral similarity between a portion of the input signal and the said estimated noise signal component, the measure being proportional to a zero-order autocorrelation of the input signal after filtering by a filter having the said coefficients; and (iv) electrical means for comparing the measure with a threshold value to produce an output indicating the presence or absence of speech.

17. A method of detecting voice activity representing signals in an electrical input signal, comprising (a) periodically adaptively generating an electrical signal representing an estimated noise signal component of the input signal, and producing signals representing the coefficients of a filter having a spectral response which is the inverse of the frequency spectrum of the estimated noise signal component;

(b) periodically forming from the input signal and the estimated noise representing signal an electrical signal representing a measure of the spectral similarity between a portion of the input signal and the said estimated noise signal component, the measure being proportional to a zero-order autocorrelation of the input signal after filtering by a filter having the said coefficients; and (c) electrically comparing the measure with a threshold valve to produce an output indicating the presence or absence of speech.

18. Voice activity detection apparatus comprising:

(i) means for receiving an electrical input signal in which the presence or absence of signals representing speech is to be detected;

(ii) analysis means responsive to said means for receiving operable to produce electrical signals representing the coefficients of a filter having a spectral response which is the inverse of the frequency spectrum of the input signal;

(iii) means for periodically adaptively generating an electrical signal representing an estimated noise signal component of the input signal;

(iv) electrical means responsive to said analysis means and said estimated noise generating means for periodically forming from the filter coefficients and the estimated noise representing signal further signals representing a measure of a spectral similarity between a portion of the input signal and the same estimated noise signal component, the measure being proportional to a zero-order autocorrelation of the noise representing signal after filtering by a filter having the same coefficients; and (v) means for comparing the measure with a threshold value to produce an output indicating the presence or absence of speech.

19. A method of detecting voice activity representing signals in an electrical input signal, comprising:

(a) producing electrical signals representing the coefficients of a filter having a spectral response which is the inverse of the frequency spectrum of the input signal;

(b) periodically adaptively generating electrical signals representing an estimated noise signal component of the input signal;

(c) periodically forming from the filter coefficients and the estimated noise representing signal an electrical signal representative of a measure of the spectral similarity between a portion of the input signal and the said estimated noise signal component, the measure being proportional to the zero-order autocorrelation of the noise representing signal after filtering by a filter having the said coefficients; and (d) comparing the measure with a threshold value to produce an output indicating the presence or absence of speech.

20. A voice activity detection apparatus comprising:

(i) a first voice activity detector which operates by forming electrical signals representing a measure of a spectral similarity between an electrical input signal and a speech free stored portion of an input signal to produce an electrical output signal indicating the presence or absence of speech in the input signal;

(ii) a store for containing the stored portion of the input signal; and (iii) an auxiliary voice activity detector responsive to said electrical input signal to produce a second signal indicating the presence or absence of speech in the input signal, said second signal alone controlling the updating of said store, the auxiliary voice activity detector operating by forming an electrical signal representing a measure of a spectral similarity between a current input signal and an earlier portion of the input signal.

21. A voice activity detection apparatus comprising:

(i) means for receiving an electrical input signal in which the presence or absence of signals representing speech is to be detected;

(ii) a store for storing an estimated noise representation signal;

(iii) means responsive to said means for receiving for periodically forming from the input signal and the stored estimated noise representation signal an electrical signal representing a measurement of the spectral similarity between a portion of the input signal and the said estimated noise signal component;

(iv) electrical means for comparing the measure with a threshold value to produce an output indicating the presence or absence of speech;

(v) an auxiliary voice activity detector, operating by forming an electrical signal representing a measure of spectral similarlity between the input signal and a preceding portion of the input signal to produce a control signal indicating the presence or absence of speech; and (vi) store updating means operable to update the store from said electrical input signal only when said control signal indicates that speech is absent.

22. Apparatus according to claim 21, further comprising means for adjusting the said threshold value during periods when speech is indicated by said control signal to be absent.

23. Apparatus according to claim 21 or 22, in which said auxiliary voice activity detector further comprises voiced speech detection means comprising pitch analysis means for generating a signal indicative of the presence of voiced speech, upon which the control signal produced by said auxiliary voice activity detector also depends.

* * * * *